US007312466B2

(12) United States Patent
Caldwell

(10) Patent No.: US 7,312,466 B2
(45) Date of Patent: Dec. 25, 2007

(54) HIGH EFFICIENCY SHIELD ARRAY

(75) Inventor: Steven G. Caldwell, Hendersonville, TN (US)

(73) Assignee: TDY Industries, Inc., Pittsburgh, PA (US)

( * ) Notice: Subject to any disclaimer, the term of this patent is extended or adjusted under 35 U.S.C. 154(b) by 221 days.

(21) Appl. No.: 11/138,970

(22) Filed: May 26, 2005

(65) Prior Publication Data

US 2006/0284122 A1 Dec. 21, 2006

(51) Int. Cl.
*G21F 3/00* (2006.01)

(52) U.S. Cl. ..... 250/515.1; 250/518.1; 250/507.1; 252/582

(58) Field of Classification Search ..... None
See application file for complete search history.

(56) References Cited

U.S. PATENT DOCUMENTS

| | | | | |
|---|---|---|---|---|
| 2,928,948 | A * | 3/1960 | Silversher | 250/515.1 |
| 2,991,368 | A | 7/1961 | Reissner | |
| 3,982,134 | A | 9/1976 | Housholder et al. | |
| 4,027,377 | A | 6/1977 | Roszler | |
| 4,218,622 | A | 8/1980 | McMurtry et al. | |
| 4,275,174 | A | 6/1981 | Tadokoro et al. | |
| 4,326,130 | A | 4/1982 | Ahner et al. | |
| 4,434,373 | A | 2/1984 | Christ et al. | |
| 4,521,691 | A | 6/1985 | Christ et al. | |
| 4,599,515 | A | 7/1986 | Whittemore | |
| 4,727,257 | A | 2/1988 | Grifoni | |
| 4,997,619 | A | 3/1991 | Pettus | |
| 5,156,804 | A | 10/1992 | Halverson et al. | |
| 5,198,182 | A | 3/1993 | Herrick et al. | |
| 5,262,463 | A | 11/1993 | Berzen | |
| 5,700,962 | A | 12/1997 | Carden | |
| 5,786,611 | A | 7/1998 | Quapp et al. | |
| 6,048,379 | A | 4/2000 | Bray et al. | |
| 6,166,390 | A | 12/2000 | Quapp et al. | |
| 6,517,774 | B1 | 2/2003 | Bray et al. | |
| 6,608,319 | B2 | 8/2003 | Joseph | |
| 6,927,407 | B2 * | 8/2005 | Bruchle et al. | 250/518.1 |
| 2005/0258405 | A1 * | 11/2005 | Sayala | 252/582 |

FOREIGN PATENT DOCUMENTS

| | | |
|---|---|---|
| DE | 84 37 706 | 1/1896 |
| EP | 0 220 937 | 5/1987 |
| GB | 925 505 | 5/1963 |

OTHER PUBLICATIONS

"Positron Emission Tomography," TRIUMF: Canada's National Lab for Particle and Nuclear Physics, Aug. 12, 1998, printed from http://www.triumf.ca/welcome/petscan.html on Aug. 11, 2005.

* cited by examiner

*Primary Examiner*—Jack I. Berman
*Assistant Examiner*—Zia R. Hashmi
(74) *Attorney, Agent, or Firm*—Kirkpatrick & Lockhart Preston Gates Ellis LLP; Patrick J. Viccaro

(57) ABSTRACT

Embodiments of a radiation shield are disclosed. One non-limiting embodiment of the radiation shield may comprise a first layer, a second layer, and a third layer. The first layer may include a neutron moderating material. The second layer may be adjacent the first layer and may include a neutron absorbing material. The third layer may be adjacent the second layer, and may include a photonic radiation attenuating material. At least the first layer and the second layer may be removable from the radiation shield.

27 Claims, 3 Drawing Sheets

HIGH EFFICIENCY SHIELD ARRAY

BACKGROUND

For decades, radiation shielding has been almost synonymous with bulky materials, such as concrete and/or lead, depending on the application. Concrete, often formulated with Boron, is effective as an attenuator of neutron radiation. In many neutron generating applications, including isotope generation for nuclear medical uses, several feet of borated concrete is required to attenuate neutron radiation to safe levels. Lead, although toxic, is an effective attenuator of high energy photonic radiation, such as X-rays and γ-rays.

Because of the bulk of concrete and lead as well as the mass of those materials necessary for effective shielding, most radiation-generating activities currently take place at facilities having substantial physical space and structure. Certain trends within nuclear science, for example, Positron Emission Tomography (PET), are leading towards the need to locate wide-spectrum radiation producing sources in facilities not originally designed to accommodate the weight and space requirements of conventional shielding. For example, radioisotopes used for PET often have a relatively short half-life necessitating that they be produced close to a patient. Also, the accelerator production of radioisotopes typically used for PET generates wide spectrum radiation including both photonic radiation and neutron radiation. Accordingly, there is a desire and need to practice wide-spectrum nuclear techniques in small-scale facilities where it is often not cost-effective and/or practical to create the physical structure necessary to support concrete and/or lead shielding.

Accordingly, there is a need for radiation shielding that is compact and light relative to conventional concrete or lead shielding. There is also a need for improved radiation shielding that shields wide spectrum radiation including photonic radiation and neutron radiation.

SUMMARY OF THE INVENTION

According to one aspect of the present disclosure, embodiments of a radiation shield are disclosed. The radiation shield may comprise a first layer, a second layer, and a third layer. The first layer may include a neutron moderating material. The second layer may be adjacent the first layer and may include a neutron absorbing material. The third layer may be adjacent the second layer, and may include a photonic radiation attenuating material. At least one of the first layer and the second layer may be removable from the radiation shield.

According to another aspect of the present disclosure, embodiments of a device for attenuating radiation are disclosed. The device for attenuating radiation may comprise at least a first radiation shield panel. The first radiation shield panel may comprise a first layer including a neutron moderating material, and a second layer adjacent the first layer. The second layer may include a neutron absorbing material. The first radiation shield panel may also comprise a third layer adjacent the second layer, wherein the third layer comprises a photonic radiation attenuating material. At least one of the first layer and the second layer may be removable from the first radiation shield panel.

According to another aspect of the present disclosure, embodiments of an apparatus are disclosed comprising a radiation-emitting source and a radiation shield positioned adjacent the radiation-emitting source. The radiation shield may comprise a first layer including a neutron moderating material and a second layer adjacent the first layer. The second layer may include a neutron absorbing material. The radiation shield may also comprise a third layer adjacent the second layer. The third layer may include a photonic radiation attenuating material. At least one of the first layer and the second layer may be removable from the radiation shield panel.

According to yet another aspect of the present disclosure, methods of shielding an object from a radiation source are disclosed. The methods may comprise the step of placing a radiation shield intermediate the object and the radiation source. The radiation shield may comprise a first layer including a neutron absorbing material, and a second layer including a photonic radiation attenuating material. The methods may also comprise the step of monitoring the neutron transmissivity of the radiation shield and replacing at least a portion of the first layer when the neutron transmissivity of the radiation shield exceeds a predetermined value.

According to another aspect of the present disclosure, embodiments of a radiation shield are disclosed. The radiation shield may comprise a first layer including a neutron moderating material and a neutron absorbing material. The radiation shield may also comprise a second layer adjacent the first layer. The second layer may include a photonic radiation attenuating material. The first layer may be removable from the radiation shield.

DESCRIPTION

The term "neutron moderating material" refers to any material tending to reduce the energy of incident neutron radiation toward thermal levels. Non-limiting examples of neutron moderating materials include water and hydrogen-rich polymers.

The term "neutron absorbing material" refers to any material with a neutron capture cross section making the material suitable for use as a shield for incident neutron radiation. Non-limiting examples of neutron absorbing materials include boron, cadmium, gadolinium and or compounds incorporating boron, cadmium, and gadolinium.

The term "photonic radiation attenuating material" refers to any material tending to reduce the intensity of incident photonic radiation. Non-limiting examples of photonic radiation attenuating materials include lead, tungsten and depleted uranium.

The term "adjacent," when used in relation to two or more objects, refers to objects that are in close physical proximity. Adjacent objects may or may not physically touch one another, and may have air, other materials, or objects positioned intermediate them.

The term "burn out" refers to a state of a neutron absorbing material, or a portion thereof, resulting from neutron capture, wherein the neutron transmissivity of the material or material portion exceeds a predetermined value.

The term "hydrogen-rich polymer" refers to a polymer including hydrogen atoms in a concentration greater than or about equal to the hydrogen concentration of water ($\sim 8\times10^{22}$ atoms H per $cm^3$).

The term "tungsten heavy alloy" refers to an alloy including at least about 50% tungsten by weight and preferably between 88% and 97% tungsten by weight. Certain embodiments of tungsten heavy alloys comprise other elements such as, for example, nickel, iron, copper, cobalt, and/or transition metals.

Figure 1:
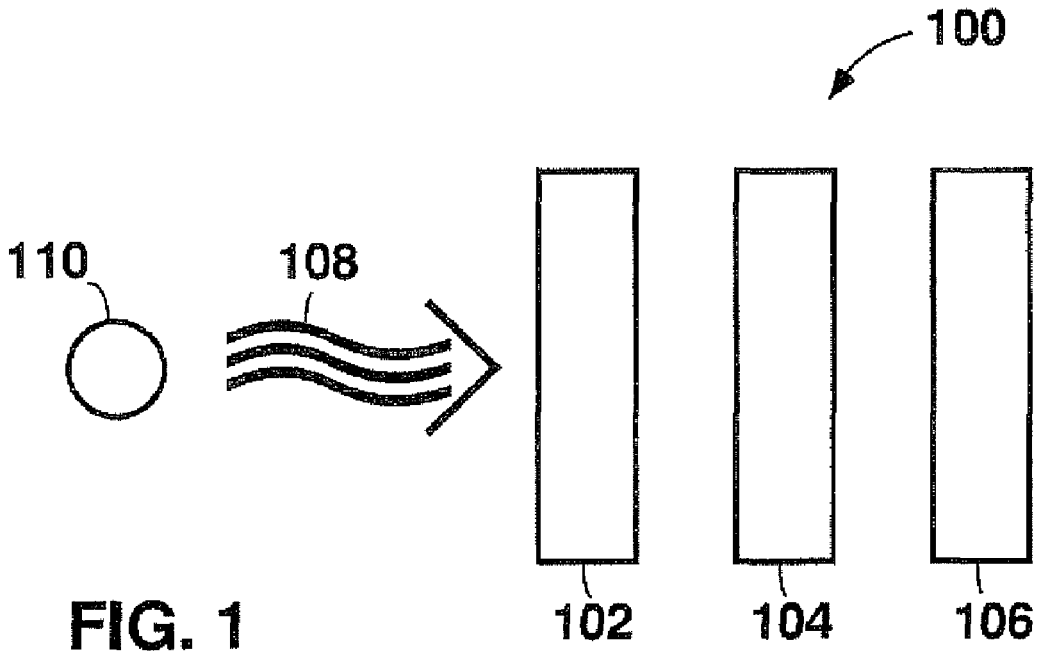
FIG. 1 is a schematic representation of a radiation shield according to various embodiments of the present invention.

FIG. 1 illustrates a configuration of a radiation shield 100 according to various non-limiting embodiments of the present invention. A radiation source 110 may emit radiation 108, for example, in the direction of the radiation shield 100. The radiation source 110 may be any device, material, or reaction generating radiation. For example, the radiation source 110 may be a cyclotron target or other apparatus for generating radioactive isotopes such as those that may be used for nuclear medical applications. The radiation 108 may include any kind of radiation including, for example, γ-rays, X-rays, α-radiation, β-radiation, and neutron radiation.

The radiation shield 100 may include a series of functional layers. A neutron moderating layer 102 may moderate the energy of incoming neutrons, e.g., neutrons emitted by the radiation source 110, to thermal levels, for example, for more efficient capture. A neutron absorbing layer 104 may capture the neutrons. A photonic radiation attenuating layer 106 may attenuate photonic radiation 108 emitted from the radiation source 110 as well as, for example, γ-rays emitted by layers 102, 104. It will be appreciated that materials included in one or more of the neutron moderating layer 102, the neutron absorbing layer 104, and/or the photonic radiation attenuating layer 106 may also attenuate α-radiation and/or β-radiation. It will also be appreciated that layers of additional material, such as, for example, polystyrene or a metallic alloy, may be included between the layers 102, 104, 106. The additional material may, for example, aid in heat dissipation, modify the mechanical properties of the shield 100, and/or facilitate removal of a layer or layers from the shield 100.

The layers 102, 104, 106 of the radiation shield 100 may be physically joined together according to any suitable means. In various embodiments, the neutron moderating layer 102 and/or the neutron absorbing layer 104 may be joined to the other layer/layers of the radiation shield 100 in a manner that allows layers 102, 104 to be easily replaced on burn out, or for other reasons. For example, the layers 102, 104, 106 may be joined directly to one another with a light adhesive. When one or more of the layers 102, 104 burn out, then they may be pulled from the layer 106, breaking the adhesive bond. Replacement layers equivalent to layers 102, 104 may be installed by applying additional light adhesive.

In other various embodiments, the layers 102, 104, 106 may be slideably installed into a frame structure. The layers 102, 104, 106 may be secured within the frame structure by a latch or other suitable mechanism. On burn out, layers 102 and/or 104 may be slid out of the frame structure and replacement layers may be installed. In yet other embodiments, the layers 102, 104, 106 may be secured to one another by suitable fasteners including, for example, screws and/or bolts.

The neutron moderating layer 102, neutron absorbing layer 104, and photonic radiation attenuating layer 106 may include any materials capable of performing the desired function. For example, neutron moderating layer 102 of radiation shield 100 may include any suitable neutron moderating material. In various non-limiting embodiments, the neutron moderating layer 102 may include polyethylene (PE), or any suitable hydrogen-rich polymer or material. Neutrons encountering an embodiment of the neutron moderating layer 102 including PE may collide elastically with one or more hydrogen nuclei present in the PE, reducing the energy of the colliding neutrons to thermal levels. The use of low atomic number elements in layer 102 may also cause the attenuation of β radiation with only minimal Bremsstrahlung X-ray generation.

In various embodiments, the neutron moderating properties of neutron moderating layer 102 may degrade over time, for example, due to protium conversion. Thermal degradation of the neutron moderating layer 102 may also occur in cases where high radiation flux deposits a large amount of energy within a relatively small volume of a polymer possessing only limited thermal conductivity. Thus, the PE may suffer reduced mechanical integrity due to both heat related damage and radiation-induced depolymerization.

In addition, the performance of embodiments of neutron moderating layer 102 including, for example, PE as a neutron moderator may degrade over time due to protium conversion. In some collisions between a neutron and a hydrogen nucleus within the PE, the hydrogen nucleus may capture the neutron, converting the hydrogen nucleus from protium to deuterium and emitting a γ photon with energy of 2.22 MeV. This may cause the functionality of the neutron moderating layer 102 to further degrade over time as it will be appreciated that the neutron moderating properties of deuterium are inferior to those of protium.

Neutron absorbing layer 104 may be made from any suitable material with a high neutron capture cross-section. For example, the neutron absorbing layer 104 may include boron, cadmium, gadolinium, and/or compounds thereof. In various embodiments, the neutron absorbing layer 104 may be made from or include gadolinium or a gadolinium compound, as gadolinium has the highest known neutron cross section of any element.

The physical form of the neutron absorbing layer 104 may vary. In certain embodiments, the neutron absorbing layer 104 may include a composite comprising a neutron absorbing material in particulate form, such as a powdered form, disbursed as a discontinuous phase in a polymer binder. The polymeric binder may be in continuous phase, though some embodiments may include a polymeric binder in discontinuous phase. Non-limiting examples of suitable polymeric binders may include polyolefins, polyamides, polyesters, silicones, thermoplastic elastomers, and epoxies as well as blends thereof. The neutron absorbing material may include any suitable material including, for example, gadolinium or a compound of gadolinium, such as, for example, gadolinium oxide, as discussed above.

In other various embodiments, the neutron absorbing layer 104 may be in metallic form. In metallic form, neutron absorbing materials may be alloyed with different metals. For example, gadolinium may be alloyed with aluminum, copper, etc. The metallic form of the neutron absorbing layer 104 may have superior thermal characteristics which may help dissipate heat generated in the layer 104 as well as the neutron moderating layer 102. Also, the physical integrity of a metallic form may facilitate fastening the layer 104 to the other layers 102, 106 of the radiation shield 100, for example, by including holes for fasteners, including threaded holes for threaded fasteners such as, for example, screws.

Gadolinium, and other neutron absorbing materials, may lose their effectiveness as neutron absorbers, e.g., burn out, over time. Natural gadolinium has a very high neutron capture cross section on average (~48,700 barns). Much of the average value, however, is due to the exceptionally high neutron capture cross section of a few isotopes. This is demonstrated by Table I, which shows the neutron capture cross sections and crustal abundance of various isotopes of gadolinium.

TABLE I

Neutron Cross Sections of Gadolinium (Gd) Isotopes

| Isotope | Crustal Abundance (%) | Neutron Capture Cross Section (barns) |
|---|---|---|
| $_{64}Gd^{152}$ | 0.2 | 700 |
| $_{64}Gd^{154}$ | 2.2 | 60 |
| $_{64}Gd^{155}$ | 14.8 | 61,000 |
| $_{64}Gd^{156}$ | 20.5 | 2 |
| $_{64}Gd^{157}$ | 15.6 | 254,000 |
| $_{64}Gd^{158}$ | 24.8 | 2 |
| $_{64}Gd^{160}$ | 21.9 | 2 |

As gadolinium atoms that may be present in neutron absorbing layer 104 capture neutrons, they may change from one isotope to another of increasing atomic weight, eventually settling into an isotope with a relatively low neutron capture cross section. As this happens, the functionality of the neutron absorbing layer 104 may slowly degrade. This may eventually lead to burn out when the neutron absorbing properties of these layers drop below the predetermined acceptable level, prompting replacement.

The photonic radiation attenuating layer 106 may attenuate radiation components included in the radiation 108, but not completely attenuated by the other layers in the radiation shield. For example, in various embodiments, the radiation 108 may include photonic radiation, such as γ-rays and X-rays that are not effectively attenuated by the other layers of the shield 100. Also, it will be appreciated that neutron capture events in either the neutron moderating layer 102 or the neutron absorbing layer 104 may create a γ-ray with energy of 2.22 MeV.

The photonic radiation attenuating layer 106 may be made from any material that attenuates photonic radiation, such as, for example, γ-rays and X-rays. Such materials include, for example, lead (Pb), an alloy or compound of Pb, or preferably a Pb substitute material. For example, in various embodiments, the photonic radiation attenuating layer 106 may include tungsten (W), depleted uranium, or any other Pb substitute material, in pure, alloy, and/or compound form.

The photonic radiation attenuating layer 106 may take various physical forms. For example, in various embodiments, the photonic radiation attenuating layer 106 may comprise a polymeric binder and a discontinuous phase of dispersed particulate filler material, for example, tungsten or a compound or alloy of tungsten in particulate form. In one non-limiting embodiment, the dispersed particulate filler material may be powdered ferrotungsten. The polymeric binder may be present as either a continuous or discontinuous phase, and may, for example, include a polyolefin, a polyamide, a polyester, a silicone, a thermoplastic elastomer, and/or an epoxy, as well as blends thereof.

In other various embodiments, the photonic radiation attenuating layer 106 may include metallic material, for example, a sheet of sintered or rolled tungsten or tungsten alloy, such as a tungsten heavy alloy. For example, an embodiment of a photonic radiation attenuating layer 106 may include one or more tungsten heavy alloys. Providing layer 106 in a substantially or entirely metallic form may provide advantageous heat dissipation, and may also provide physical integrity, facilitating the fastening together of the various layers in the radiation shield. For example, a metallic layer 106 may include threaded holes for fasteners such as screws and bolts.

Figure 2:
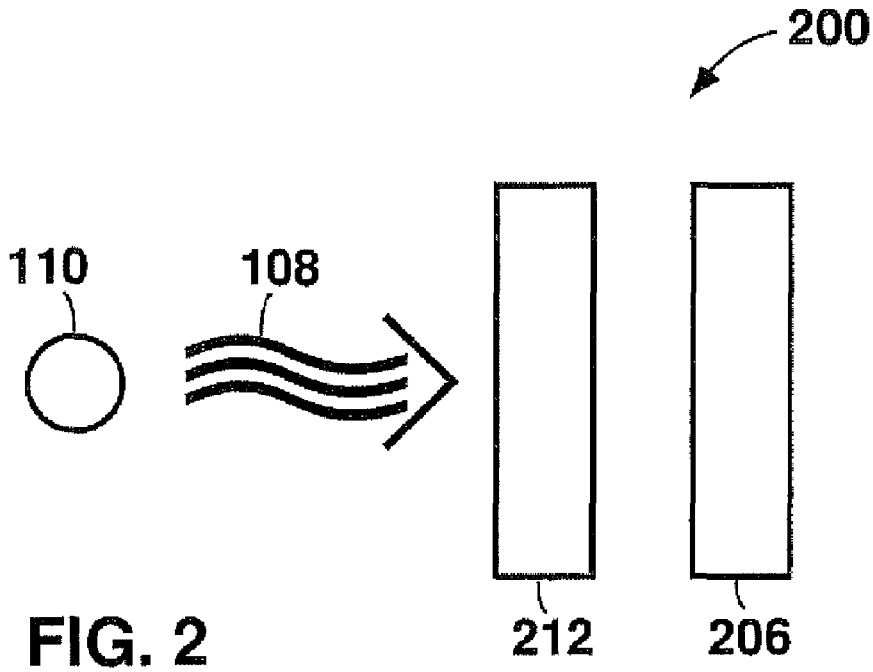
FIG. 2 is a schematic representation of a radiation shield according to various embodiments of the present invention.

In various embodiments, the functionality of two or more of the layers of the radiation shield 100 may be combined in a single layer. For example, FIG. 2 shows a radiation shield 200 including mixed-function layer 212 and photonic radiation attenuating layer 206. The mixed-function layer 212 may perform the functions of both the neutron moderating layer 102 and the neutron absorbing layer 104 of the radiation shield 100. The photonic radiation attenuating layer 206 of radiation shield 200 may perform a function equivalent to that of photonic radiation attenuating layer 106 of the radiation shield 100.

In one non-limiting embodiment, mixed-function layer 212 of shield 200 may include a composite of a neutron absorbing material disbursed in a polymeric binder. The polymeric binder may include a hydrogen rich polymer such as, for example, PE, which may give the layer 212 neutron moderating properties as discussed above. Accordingly, layer 212 may perform both neutron moderating and neutron absorbing functions. It will be appreciated that neutron moderating and absorbing materials that may be present in mixed-function layer 212 may also degrade and/or burn out as discussed above with respect to neutron moderating layer 102 and neutron absorbing layer 104, ultimately necessitating replacement of the mixed-function layer 212.

Figure 3:
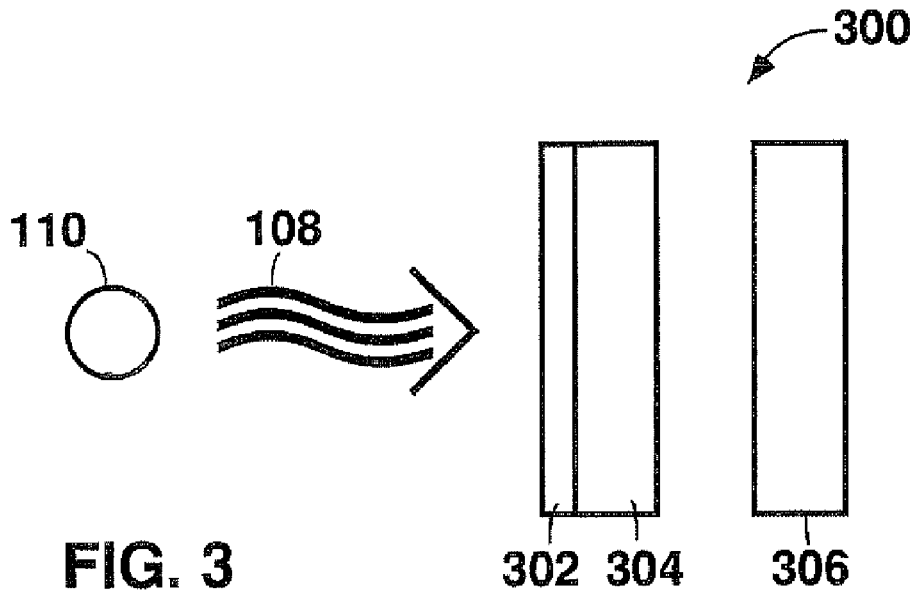
FIG. 3 is a schematic representation of a radiation shield according to various embodiments of the present invention.

In other non-limiting embodiments, two or more of the neutron moderating layer 102, neutron absorbing layer 104, and the photonic radiation attenuating layer 104 may be bonded to one another in a permanent manner. For example, FIG. 3 shows a non-limiting embodiment of a radiation shield 300 including neutron moderating layer 302 bonded to neutron absorbing layer 304. On burn out, the layers 302, 304 may be replaced together without the need to separate them. In various non-limiting embodiments, the layers 302 and 304, may be simultaneously extruded in a low temperature, cold forming process and/or in a high temperature extruding process. This may facilitate a bond between polymers that may be included in one or more of layers 302, 304. In other non-limiting embodiments, the layers 302, 304 may be welded and/or joined using an adhesive. Other techniques of joining layers 302, 304 will be readily apparent to those having ordinary skill in the art.

The radiation shields 100, 200, 300 may be constructed as a single multi-layered monolithic unit, or as a plurality of joined multi-layered panels. The panels may be of any suitable shape, for example, squares or rectangles. In various non-limiting embodiments, panels may have curvature, for example, allowing the assembly of cylindrical, spherical or other geometric arrays of panels. Multiple multi-layered panels may be joined together to form any of the radiation shields 100, 200, 300 into any desired dimension or shape. For example, several multi-layered panels of any of the radiation shields 100, 200, 300 may be used to completely shield a room, for example, a room containing a radiation source, such as the radiation source 110.

Figure 4:
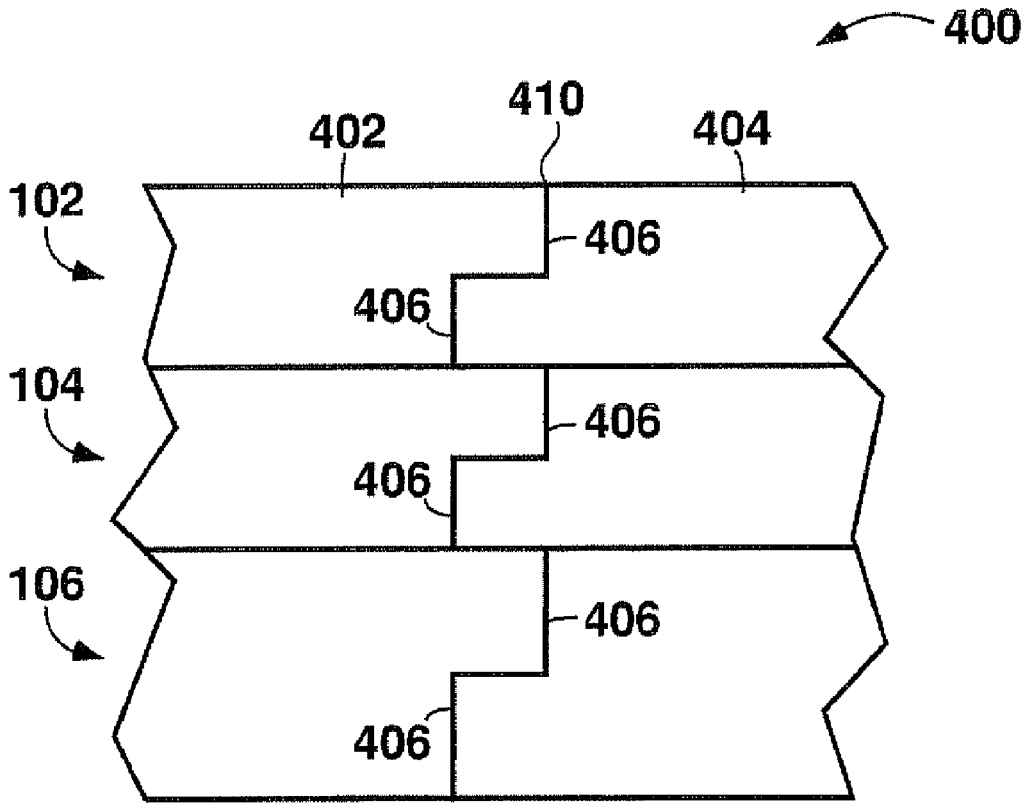
FIG. 4 is a schematic representation of an example of an interface between two radiation shield panels according to various embodiments of the present invention.

Panels of any of the radiation shields 100, 200, 300 may be joined in a manner intended to avoid straight line radiation leakage. FIG. 4 shows an interface 410 between two panels 402, 404 of exemplary radiation shield 400. The panel 402 and the panel 404 may include geometrically interlocking features 406. The interlocking features 406, unlike a typical butt joint, do not form a straight seam from one side of the radiation shield 410 to the other. A straight seam may allow elements of radiation to pass through the radiation shield 100 unattenuated.

Figure 5:
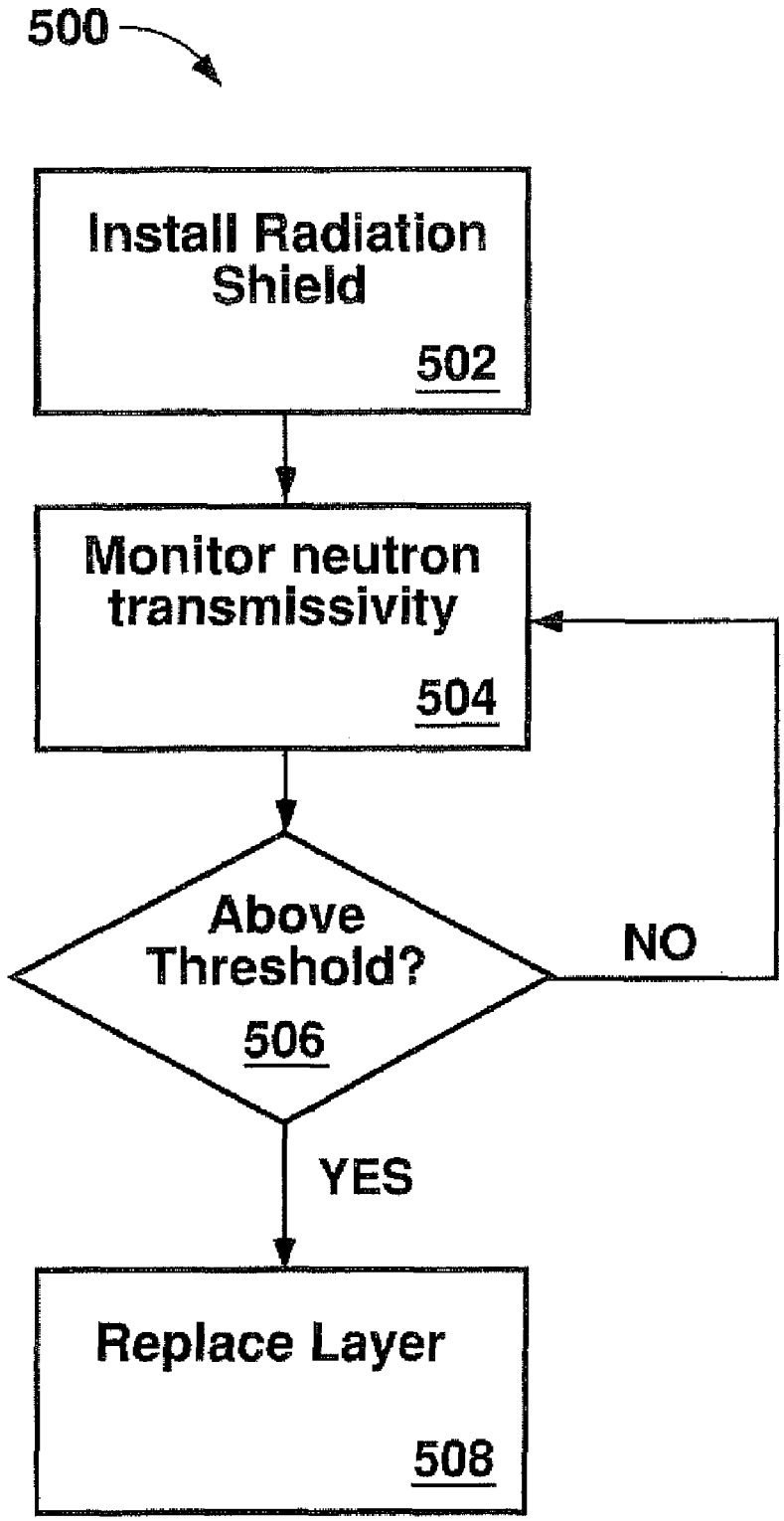
FIG. 5 is a flow chart of a process flow according to various embodiments of the present invention.

FIG. 5 shows a process flow 500 for using radiation shield 100 according to various embodiments, though the steps of the process flow 500 may be performed using any of the radiation shields 100, 200, 300, 400 above. At step 502, the radiation shield 100 may be installed. For example, the radiation shield 100 may be installed to completely shield a room or other area containing radiation source 110. At step 504, the neutron transmissivity of the radiation shield 100 may be monitored. The neutron transmissivity of the radiation shield 100 may be compared to a predetermined threshold at step 506. If the neutron transmissivity of the shield 100 is not above the predetermined threshold, then the monitoring may continue at step 504. If the neutron transmissivity of the shield 100 is above the predetermined threshold, then one or more of the neutron moderating layer 102 and the neutron absorbing layer 104 may be replaced at step 508. The same process flow may be applied to the use of radiation shields 200, 300, and 400 although with regard to shield 200, for example, replacement step 508 would involve replacement of combined neutron moderating/absorbing layer 212.

It will be appreciated that the radiation shields 100, 200, 300 described herein may be used in any application where radiation shielding is required including as non-limiting examples, PET, other nuclear medical applications, power plant maintenance applications, homeland security applications, etc.

Unless otherwise indicated, all numbers expressing quantities of energy level, dimension, and so forth used in the present specification and claims are to be understood as being modified in all instances by the term "about." Accordingly, unless indicated to the contrary, the numerical parameters set forth in the following specification and claims are approximations that may vary depending upon the properties sought to be obtained by the present invention.

While several embodiments of the invention have been described, it should be apparent that various modifications, alterations and adaptations to those embodiments may occur to persons skilled in the art with the attainment of some or all of the advantages of the present invention. For example, some steps of the process flow described above may be omitted or performed in a different order. It is therefore intended to cover all such modifications, alterations and adaptations without departing from the scope and spirit of the present invention as defined by the appended claims.

I claim:

1. A radiation shield comprising:

a first layer comprising a neutron moderating material;

a second layer adjacent the first layer, wherein the second layer comprises a particulate neutron absorbing material dispersed in a polymeric binder, wherein the particulate neutron absorbing material comprises at least one neutron absorbing material selected from the group consisting of gadolinium, a gadolinium compound, boron, and a boron compound;

a third layer adjacent the second layer, wherein the third layer comprises a photonic radiation attenuating material; and wherein at least one of the first layer and the second layer are removable from the radiation shield.

2. The radiation shield of claim 1, wherein the second layer is intermediate the first layer and the third layer.

3. The radiation shield of claim 1, wherein the neutron moderating material of the first layer comprises a hydrogen-rich polymer.

4. The radiation shield of claim 1, wherein the neutron moderating material of the first layer comprises polyethylene.

5. The radiation shield of claim 1, wherein the third layer is removable from the radiation shield.

6. The radiation shield of claim 1, wherein the first layer is bonded to the second layer, and wherein the first and second layers are removable from the radiation shield as a single unit.

7. The radiation shield of claim 1, wherein the polymeric binder includes at least one material selected from the group consisting of a polyolefin, a polyamide, a polyester, a silicone, a thermoplastic elastomer, and an epoxy.

8. The radiation shield of claim 1, wherein the second layer comprises a layer of neutron absorbing metal or alloy.

9. The radiation shield of claim 1, wherein the second layer comprises a layer of at least one of a neutron absorbing gadolinium alloy and a neutron absorbing boron alloy.

10. The radiation shield of claim 9, wherein the alloy further comprises at least one of copper and aluminum.

11. The radiation shield of claim 1, wherein the second layer comprises one of a metal or alloy layer that is at least one of rolled and cast.

12. The radiation shield of claim 1, wherein the third layer comprises a particulate photonic radiation attenuating material dispersed in a second polymeric binder.

13. The radiation shield of claim 12, wherein the particulate photonic radiation attenuating material comprises tungsten.

14. The radiation shield of claim 12, wherein the second polymeric binder includes at least one material selected from the group consisting of a polyolefin, a polyamide, a polyester, a silicone, a thermoplastic elastomer, and an epoxy.

15. The radiation shield of claim 1, wherein the third layer comprises a tungsten heavy alloy.

16. A device for attenuating radiation comprising at least a first radiation shield panel, the first radiation shield panel comprising:

a first layer comprising a neutron moderating material;

a second layer adjacent the first layer, wherein the second layer comprises a particulate neutron absorbing material dispersed in a polymeric binder, wherein the particulate neutron absorbing material comprises at least one neutron absorbing material selected from the group consisting of gadolinium, a gadolinium compound, boron and a boron compound; and a third layer adjacent the second layer, wherein the third layer comprises a photonic radiation attenuating material;

and wherein at least one of the first layer and the second layer are removable from the first radiation shield panel.

17. The device of claim 16, further comprising a second radiation shield panel, wherein the first radiation shield panel comprises a first edge and the second radiation shield panel comprises a second edge, and wherein the first edge and the second edge include interlocking features forming an interface between the first radiation shield panel and the second radiation shield panel.

18. An apparatus comprising:

a radiation-emitting source; and a radiation shield adjacent the radiation-emitting source, the radiation shield comprising:

a first layer comprising a neutron moderating material;

a second layer adjacent the first layer, wherein the second layer comprises a particulate neutron absorbing material dispersed in a polymeric binder, wherein the particulate neutron absorbing material comprises at least one neutron absorbing material selected from the group consisting of gadolinium, a gadolinium compound, boron, and a boron compound; and a third layer adjacent the second layer, wherein the third layer comprises a photonic radiation attenuating material;

and wherein at least one of the first layer and the second layer are removable from the radiation shield panel.

19. A method of shielding an object from a radiation source, the method comprising:

placing a radiation shield intermediate the object and the radiation source, wherein the radiation shield comprises:

a first layer comprising a particulate neutron absorbing material dispersed in a polymeric binder, wherein the particulate neutron absorbing material comprises at least one neutron absorbing material selected from the group consisting of gadolinium, a gadolinium compound, born, and a boron compound, and a second layer comprising a photonic radiation attenuating material;

monitoring the neutron transmissivity of the radiation shield; and replacing at least a portion of the first layer when the neutron transmissivity of the radiation shield exceeds a predetermined value.

20. The method of claim 19, wherein the second layer further comprises a neutron moderating material.

21. A radiation shield comprising:

a first layer comprising a particulate neutron absorbing material dispersed in a polymeric binder, wherein the particulate neutron absorbing material comprises at least one neutron absorbing material selected from the group consisting of gadolinium, a gadolinium compound, boron, and a boron compound;

a second layer adjacent the first layer, wherein the second layer Comprises a photonic radiation attenuating material; and wherein the first layer is removable from the radiation shield.

22. The radiation shield of claim 21, wherein the polymeric binder comprises a hydrogen rich polymer.

23. The radiation shield of claim 22 wherein the hydrogen rich polymer includes polyethylene.

24. The radiation shield of claim 21, wherein the polymeric binder includes at least one material selected from the group consisting of a polyolefin, a polyamide, a polyester, a silicone, a thermoplastic elastomer, and an epoxy.

25. The radiation shield of claim 21, wherein the third layer comprises a tungsten heavy alloy.

26. The radiation shield of claim 21, wherein the third layer comprises a particulate photonic radiation attenuating material dispersed in a second polymeric binder.

27. The radiation shield of claim 26, wherein the particulate photonic radiation attenuating material comprises tungsten.

* * * * *